United States Patent [19]

Carubia

[11] Patent Number: 4,476,461

[45] Date of Patent: Oct. 9, 1984

[54] OCCUPANCY MONITOR

[76] Inventor: José C. Carubia, Rioja 2030, 2000 Rosario, Argentina

[21] Appl. No.: 289,133

[22] Filed: Aug. 3, 1981

Related U.S. Application Data

[63] Continuation-in-part of Ser. No. 5,584, Jan. 22, 1979, abandoned.

[30] Foreign Application Priority Data

Jan. 24, 1978 [AR] Argentina ..... 270832

[51] Int. Cl.[3] ..... G08B 21/00

[52] U.S. Cl. ..... 340/667; 340/52 F; 340/539; 340/545; 346/59

[58] Field of Search ..... 340/667, 666, 539, 545, 340/52 F, 53; 346/59, 60

[56] References Cited

U.S. PATENT DOCUMENTS

| | | | |
|---|---|---|---|
| 920,993 | 5/1909 | Pim | 346/60 |
| 2,852,766 | 9/1958 | Green | 340/545 |
| 3,343,624 | 9/1967 | Shaheen | 340/667 |
| 3,605,110 | 9/1971 | Southward et al. | 346/59 |
| 3,634,866 | 1/1972 | Meyer | 346/59 |
| 3,858,181 | 12/1974 | Goldsby et al. | 340/524 |
| 3,906,441 | 9/1975 | Andersen et al. | 340/667 |
| 4,001,777 | 1/1977 | Alexander | 340/667 |
| 4,208,664 | 6/1980 | Mattori | 346/60 |

*Primary Examiner*—Glen R. Swann, III

*Attorney, Agent, or Firm*—Browdy & Neimark

[57] ABSTRACT

Occupancy is monitored at a plurality of locations, such as stores, seats or chairs, hotel beds or rooms, doorway passages, service establishments, or the like, and a record is provided of the time of occupancy. The system has respective occupancy-controlled switches in electric circuits providing occupancy signals at the respective locations. These signals are fed via a transmitting circuit, which suitably selects the recorder channels, to a multi-trace recorder, and in conjunction with a clock, provides a timed record of occupancy on the respective recorder traces associated with the monitored locations. The data may be printed on a moving paper recorder strip or may be in the form of magnetic recordings on the magnetic tape of a tape recorder. Timed recordings of fault disturbances may be similarly obtained.

8 Claims, 5 Drawing Figures

PRINTER
73
7
ERASE
LINE FAULT DETECTOR
8
INTERFACE UNIT
CLOCK
6
72
62
70
43
LINE
8
38
22

IDENTIFICATION PULSES
5
PROCESSOR
OR
45
AND
44
4
61
GATE
OR
54
60
AND
55
DECIMAL COUNTER
1 2 3 4 5 6 7 8 9 10
56
MEMORY
42
FF
FF
41
3
ERASE
ERASE
57
DECIMAL COUNTER
53
39
40
+
-
2
23
38
22
DETECTOR
N.C. OCCUPANCY SWITCH
52
SCANNING PULSE GENERATOR

OCCUPANCY MONITOR

CROSS-REFERENCE TO RELATED APPLICATIONS

The present application is a continuation-in-part of the application of Jose Costa Carubia, Ser. No. 5,584, abandoned, entitled "Occupancy Monitor", filed Jan. 22, 1979.

FIELD OF THE INVENTION

This invention relates to an occupancy monitor, and more particularly to a monitoring system of the type providing a printed or otherwise recorded record of occupancy.

BACKGROUND OF THE INVENTION

The standard monitoring of persons essentially involves recording the traffic. For example, there is a need for monitoring and recording the number of people entering places of amusement, rooms, buildings and the like. When the traffic itself does not involve charges, there may be a need for monitoring services rendered, while ignoring the meaningless traffic.

SUMMARY OF THE INVENTION

A main object of the present invention is to provide a novel and improved occupancy monitoring system which overcomes the disadvantages and deficiencies of previously known traffic monitoring systems.

A further object of the invention is to provide an improved occupancy monitoring system which may be used in various locations whose occupancy must or should be monitored and recorded, such as stores, seats or chairs, hotel beds or rooms, doorway passages, service establishments, and the like, the system being especially useful for simultaneously monitoring a plurality of locations in a particular area and for providing a continuous record of occupancy, A still further object of the invention is to provide an improved electrically operated occupancy detection and recording system which is relatively easy to install, which involves relatively inexpensive components, which is automatic in operation, and which simultaneously detects and records occupancy, and the time thereof, for a plurality of locations in a particular area, and which also provides a time record of electrical failures of the system.

BRIEF DESCRIPTION OF THE DRAWINGS

Further objects and advantages of the invention will become apparent from the following description and claims, and from the accompanying drawings, wherein:

DETAILED DESCRIPTION OF PREFERRED EMBODIMENTS

Figure 1:
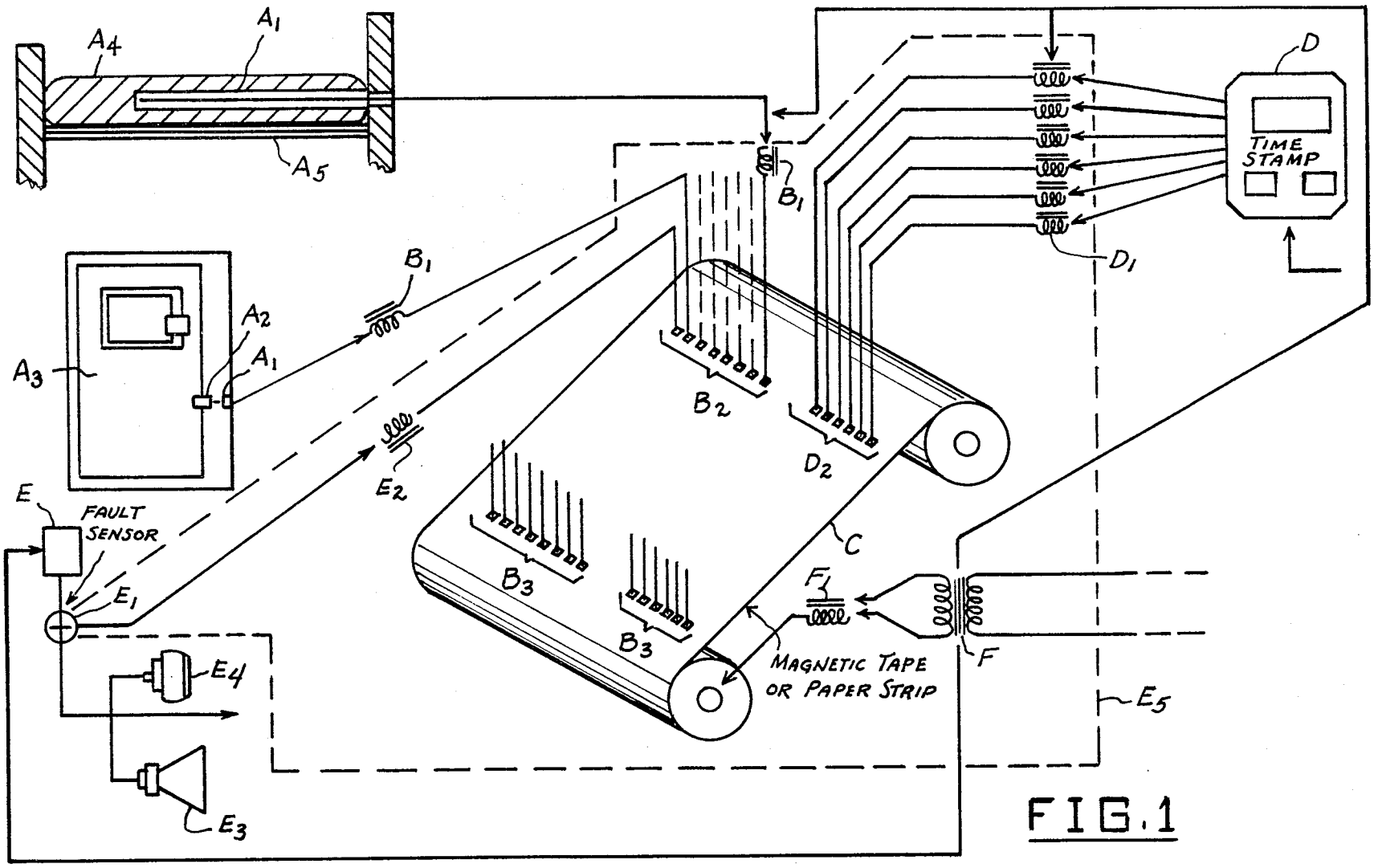
FIG. 1 is a partially schematic diagram illustrating a system according to the present invention, showing the storage element thereof in pictorial form as viewed from the top, and its relationships to the other components.

Monitoring of services is performed on furniture, apparatus or units where the customer is located (vibrator in a beauty salon, barber or hairdresser chair, bed or doorway of a hospital or hotel room, etc.). In the case of a hotel, for example, peripheral detectors $A_1$, preferably made up of electric switches, preferably connected operatively to latches $A_2$ of door panels $A_3$ are provided. These detectors $A_1$ can also be installed inside mattresses $A_4$ on beds $A_5$. Application of ambient detectors is also provided. The detectors $A_1$ are connected respectively to relays $B_1$ which actuate respective signal recording heads $B_2$, able to mark or to record on a multiple-trace storage member C, in this case a mobile paper strip or magnetic tape, see FIG. 1 ( the broken lines illustrate connections for other units). The storage member C can, of course, be constituted by an internal memory of an electronic circuit or a magnetic recording tape system, or the like. When a unit experiences a change (occupancy, or termination of occupancy), its detector $A_1$ reports the occurrence to the storage member C via its associated relay $B_1$ and head $B_2$, and the trace thus made identifies the affected unit. A time stamp device D simultaneously provides signals indicating the time of the occurence, which signals are to be printed or recorded on the storage member C. The time stamp device D is connected to a plurality of relays $D_1$, which in turn are connected to activate recordings heads $D_2$, which print or record the time on storage member C. The apparatus is also provided with a device E for protecting the recorded data. When a line is cut accidentally or intentionally, this occurence is picked up a by a sensor $E_1$ ( only one being shown) that actuates a relay $E_2$ to print or record on the storage member C an alarm signal and identification of the unit affected, actuating at the same time the time stamp device D at the time of occurrence. Sirens $E_3$ and/or lights $E_4$ can be added for immediate alarm reporting. The storage member C, which in the illustrated embodiment is a mobile paper strip or magnetic tape, can be provided as shown, divided into tracks that can be assigned to the various units to be monitored or else to different types of signals (occupancy or beginning of occupancy, termination of occupancy, alarm, time and identification of the unit affected). The device E for protecting the data can include an armored box shown diagrammatically as armored box $E_5$. For example, the illustrated sensor $E_1$ can be so positioned that when the box $E_5$ is opened the sensor $E_1$ produces a signal which is fed to one of the recording heads $B_2$ via the relay $E_2$, and this recording head generates a signal which is recorded on the storage member C. Playback heads $B_3$ can be provided adjacent the storage member C for extracting the data stored thereon. The armored box $E_5$ contains the storage member C and related devices.

A transformer F feeds an electrodynamic member $F_1$, an electric motor, which drives the storage device C during each impression. Power is supplied from a source operatively connected to different components, the electric transformer F being provided for that purpose. The entire device can be intended for a single unit, so that a single detector is sufficient. Various detection and transmission devices can be used. The detectors can be a respective switch or circuit which picks up heart beat or other human attributes. Devices such as selectors, generators, processors, analyzers etc., indicated by reference G, (FIG. 2) can be added. Since it will be easy to replace some of the elements described by similar means for the same purpose, one can refer to FIG. 2 which is indicative of the scope and options of the invention, illustrated schematically. Playback heads $B_3$, in the case where the storage member C is a magnetic tape, may be provided for facilitating extraction of data stored on the date storage member C.

Figure 2:
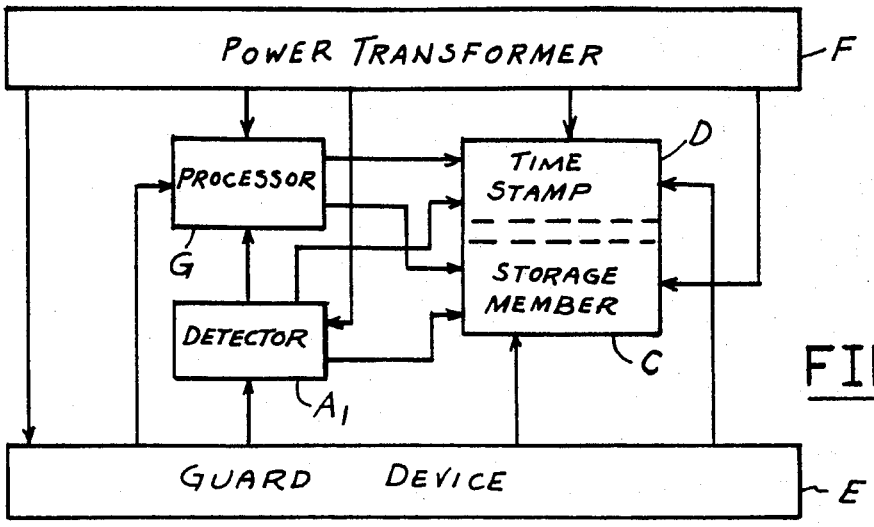
FIG. 2 is a schematic block diagram of the system of FIG. 1.

In FIG. 2 a general schematic block diagram is shown of a system using the present invention. A storage member C, time stamp D, guard device E, power transformer F, a processor G and detector $A_1$ are shown, the interconnections being illustrated by arrow-headed lines.

Figure 3:
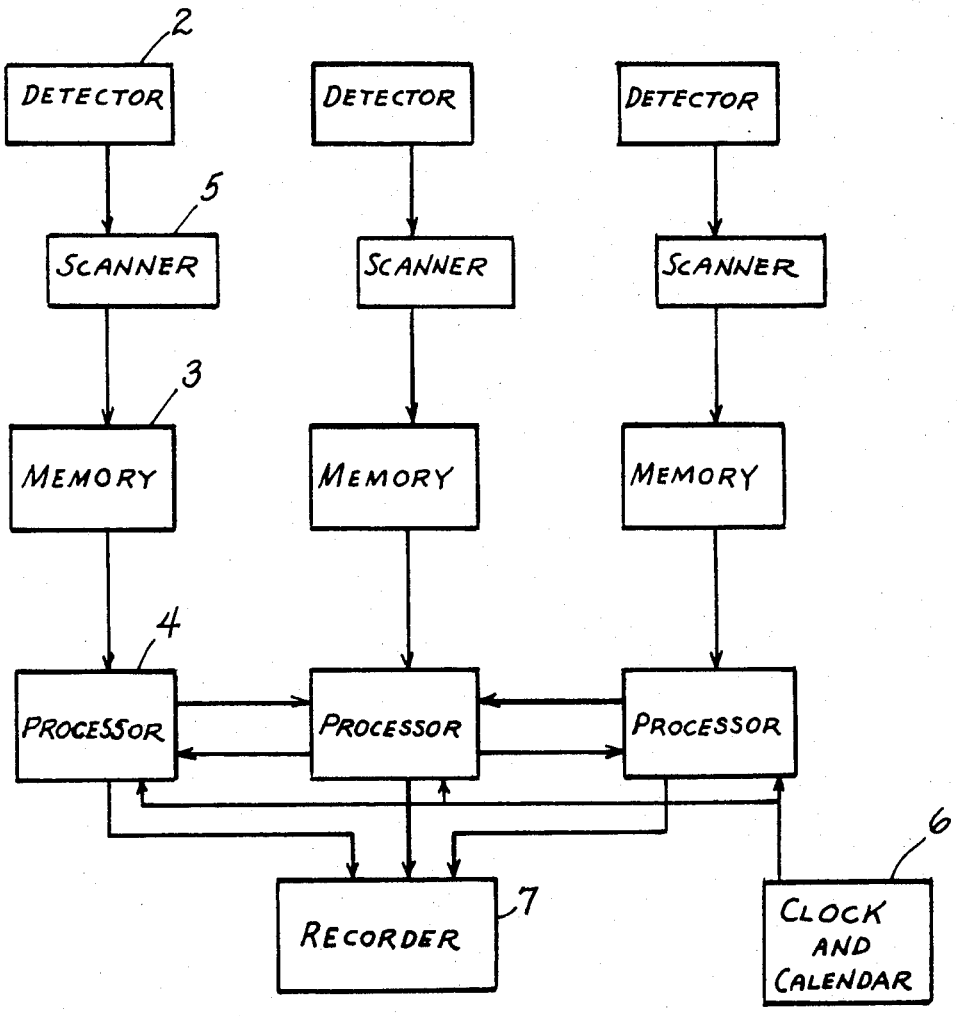
FIG. 3 is a block diagram of another embodiment of an occupancy monitoring system according to the present invention.

FIG. 3 generally illustrates a multi-channel occupancy detection and recording system according to the present invention, each channel comprising a detector 2, a scanning device 5, a memory device 3, and a processor 4. The outputs of the processors are connected to the respective inputs of a multi-channel recorder 7. An electronic clock 6 is also included in the system, preferably including an electronic calendar.

Figures 4, 5:
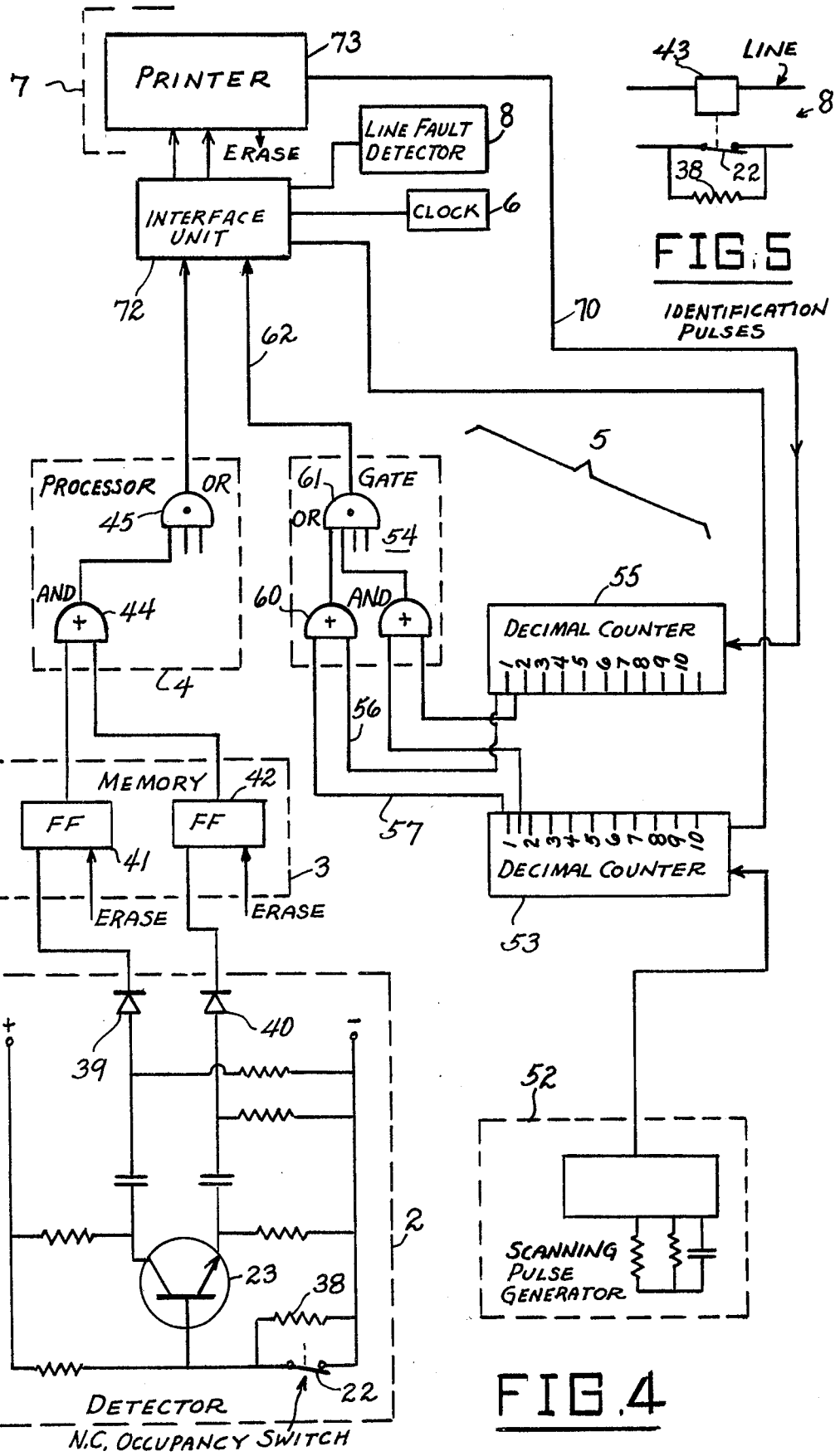
FIG. 4 is a partial schematic diagram illustrating a specific embodiment of an occupancy monitoring system substantially according to FIG. 3.
FIG. 5 is a wiring diagram of a typical line fault detection circuit which may be employed with the circuit of FIG. 4.

FIG. 4 illustrates an optional design for a channel of a multi-channel system substantially according to the generalized concept of FIG. 3.

Each channel begins with a detector stage 2 which includes a normally-closed occupancy-controlled, or fault-controlled, sensor switch 22 which responds to the events which mark the beginning and the end of occupancy or of a fault condition. Switch 22 is connected in the base return circuit of a transistor 23 and is shunted by a resistor 38. The operation of switch 22 affects the base voltage, and hence the operational current of transistor 23. Transistor currents are transmitted via diodes 39, 40 to inputs of internal memory flip-flop units 41, 42 of a memory block 3.

The information of memory block 3 is held until it is released, via a processor stage 4 and an interface stage 72 by operation of a scanner circuit in a scanner block 5.

The processor stage 4 is capable of sensing, decoding and suitably processing the information from memory block 3 so as to deliver it to the appropriate channel or the associated recorder 7, namely, to the associated printing or recording head assembly of the recorder.

The line fault-detecting device 8 may be connected directly to the interface unit 72.

The scanner 5 includes gate circuits 54 which are capable of checking the detector-derived signals to verify their identities.

The processor outputs received in interface unit 72 are suitably combined with "date-hour" information from the clock circuit 6. Therefore, the recorder 7 receives the necessary concurrent date and time information to print it out on the paper recording tape or to record it on the magnetic tape, magnetic cartridge or cassette, if such is employed.

The line fault detector 8 may comprise a detector circuit 2 with a fault-responsive switch 22 (such as the contacts of a suitable current relay 43 whose winding is connected in series with the line), as shown in FIG. 5.

The apparatus is energized from a suitable transformer, such as the transformer F shown in FIG. 1.

As mentioned above, changes in state of the transistor 23 are detected by the two diodes 39 and 40, which give "open" or "close" signals, which are transmitted to memory 3, which may comprise flip-flop units 41, 42 functioning as a transient memory unit. The signals are fed subsequently to the processor 4, which comprises gate circuitry, including AND gate 44 and OR gate 45, which collect the information from different detector units 2, which is in turn delivered to the interface unit 72 which controls the printer 73.

Designated at 52 is a generator of scanning pulses, which are supplied to a decimal counter 53. Decimal counter 53 supplies these pulses to an AND gate 60, part of the gate circuitry 54. The printer 73 sends pulses (comparison signals corresponding to an operated detector) to another decimal counter 55 which can deliver a coincidence pulse count signal to AND gate 60, namely, which can scan the gate circuitry 54 to determine said coincidence of the printer pulses with the operated detector pulses. Upon finding said coincidence in the gate circuitry 54, a signal is delivered via an OR gate 61 to the interface circuitry 72, causing printer 73 to print out at the corresponding channel trace.

The resistors 38 may be of different values for the different detector units in the system, so that predetermined strength output pulse signals are delivered from the detector units 2 when their occupancy-detection switches 22 are opened. Thus, the signal reaching the printer 73 responsive to occupancy will be in accordance with the particular detector switch 22 which is actuated. The printer 73 is provided with conventional pulse generating means delivering a train of identification pulses of a number in accordance with the signal delivered from the operated detector 2. Thus, when detection occurs, the printer 73 returns the detector identification comparison pulses via a feedback line 70 to said other decimal counter 55, which delivers a coincidence-checking signal via a line 56 to the AND gate 60. When this corresponds to the output signal at 57 from the decimal counter 53 (representing the pulse number corresponding to the actuated detector unit 2) gate 60 triggers OR gate 61, delivering an enabling signal via line 62 to the interface unit 72, which in turn causes operation of the appropriate associated printout element of printer 73. Said appropriate printout element is selected by the printer in accordance with the signal transmitted by the detector unit 2. At the same time as this printout occurs a corresponding "date-hour" signal from clock unit 6 is furnished to the interface unit 72, causing printout of the corresponding time information along with the detector location information.

Similarly, if a line fault occurs, a signal produced by the line fault detector 8 will cause printout by printer 73 at the line fault trace of the recorder strip, along with printout of time information from clock unit 6, via interface unit 72.

The memory units 41, 42 are erased by the printer 73 after each printout has occurred.

Preferably, the recorder circuitry is housed in a secure box provided with two doors having locks with different keys or having locks operated by different combinations. Also, the system may be provided with suitable battery-operated fault alarm circuits energized by the occurrence of fault conditions.

While preferred illustrative embodiments of this invention have been described and illustrated, it is to be appreciated that other embodiments and variants are possible without departing from the spirit and scope of the invention, its scope being defined in the appended claims.

What is claimed is:

1. An occupancy monitoring system for monitoring occupancy at a plurality of locations, comprising respective detector means at said locations for detecting occupancy occurrences including means generating occupancy detection signals at the respective locations, recording means to effect recording on a storage medium of detection signals for said location, transmitting means coupled between said detector means and said recording means for feeding the respective occupancy detection signals to said recording means to effect recording on said storage medium, clock means, means connecting said clock means to said transmitting means for recording the times of said detection signals on said storage medium concurrently with the occupancy signals, wherein each said occupancy signal generator means comprises a transistor provided with energizing circuit means including a base return circuit and occupancy switch means connected in said base return circuit, wherein said recording means is of a type providing identification pulses, means to verify the number of such identification pulses, and means to enable the recording means in accordance with such verification.

2. The occupancy monitoring system of claim 1, and means generating a predetermined-strength fault signal responsive to a fault disturbance in the system, and means feeding said fault signal to said transmitting means for transmission to said recording means.

3. The occupancy monitoring system of claim 2, and alarm means, and means to actuate said alarm means responsive to such fault disturbance.

4. The occupancy monitoring system of claim 1, and wherein said base return circuit includes a base bias-controlling resistor connected across said occupancy-responsive switch means.

5. The occupancy monitoring system of claim 1, and wherein said transmitting means includes memory circuit means connected between said transistor and said recording means.

6. The occupancy monitoring system claim 1, and wherein said transmitting means includes OR gate means connected between the transistors associated with the respective detector means and said recording means for selectively connecting the outputs of the respective transistors to the recording means.

7. The occupancy monitoring system of claim 1, and wherein said transmitting means includes respective memory circuit means connected to receive the outputs of the transistors associated with the respective detector means, and OR gate means connected between the memory circuit means and the recording means arranged to selectively connect the outputs of the memory circuit means to said recording means.

8. The occupancy monitoring system of claim 1, and wherein said enabling means comprises a reference scanning pulse generator, respective decimal counters connected to receive said identification pulses from the recording means and reference pulses from the scanning pulse generator, and enabling gate means connected between the outputs of the decimal counters and the recording means.

* * * * *